US005988742A

United States Patent [19]

Stevens

[11] Patent Number: 5,988,742

[45] Date of Patent: Nov. 23, 1999

[54] PROTECTIVE COVER FOR AN INFANT IN A BABY SWING OR CARRIER

[76] Inventor: Thomas M. Stevens, 3243 S. Normal, Chicago, Ill. 60616

[21] Appl. No.: 09/059,710

[22] Filed: Apr. 14, 1998

Related U.S. Application Data

[60] Provisional application No. 60/043,680, Apr. 14, 1997.

[51] Int. Cl.[6] ..... A47C 31/00

[52] U.S. Cl. ..... 297/219.12; 297/184.13; 297/465; 297/485; 297/184.14; 5/482; 5/494; 2/69.5; 2/75

[58] Field of Search ..... 297/219.12, 228.13, 297/464, 465, 466, 487, 488, 485, 184.13, 184.14; 2/69.5, 75, 84, 310, 312; 5/482, 494

[56] References Cited

U.S. PATENT DOCUMENTS

| | | | |
|---|---|---|---|
| 1,370,009 | 3/1921 | Ehrenberg | 5/494 X |
| 1,513,410 | 10/1924 | Milkes | 2/75 |
| 1,964,271 | 6/1934 | O'Dwyer | 2/69.5 X |
| 2,008,919 | 7/1935 | Milkes | 2/69.5 |
| 2,345,592 | 4/1944 | Friedman | 2/494 X |
| 2,442,105 | 5/1948 | Vacheron | 2/69.5 |
| 2,689,148 | 9/1954 | McMullin | 2/184.14 X |
| 2,707,988 | 5/1955 | Shaub et al. | 2/69.5 X |
| 2,722,694 | 11/1955 | Bryant | 2/69.5 X |
| 2,888,009 | 5/1959 | Taylor | 2/69.5 X |
| 3,034,132 | 5/1962 | Landsberger et al. | 2/69.5 |
| 3,560,048 | 2/1971 | Flint | 297/465 |
| 3,835,471 | 9/1974 | Lankford | 2/84 |
| 3,962,738 | 6/1976 | Menditto | 5/494 |
| 4,188,065 | 2/1980 | Meeker | 297/485 |
| 4,241,458 | 12/1980 | Lesesne | 2/69.5 |
| 4,311,339 | 1/1982 | Heath | 297/464 X |
| 4,441,223 | 4/1984 | Yang | 5/494 |
| 4,759,082 | 7/1988 | Mulligan | 2/75 X |
| 4,773,101 | 9/1988 | Kapp et al. | 2/75 X |
| 4,897,885 | 2/1990 | Lunt | 2/75 X |
| 4,946,221 | 8/1990 | Livingston | 297/184.13 |
| 4,993,090 | 2/1991 | Ranalli | 5/494 X |
| 5,168,579 | 12/1992 | Marshall | 2/84 X |
| 5,243,724 | 9/1993 | Barnes | 297/219.12 X |
| 5,309,586 | 5/1994 | Sies et al. | 297/184.13 X |
| 5,421,045 | 6/1995 | Bowen | 5/482 X |
| 5,437,061 | 8/1995 | Kenner | 297/184.13 X |
| 5,549,354 | 8/1996 | Rosen | 297/184.13 |
| 5,551,108 | 9/1996 | Butler, III | 5/494 X |
| 5,692,257 | 12/1997 | Albertieri | 5/494 X |
| 5,781,946 | 7/1998 | McEntire et al. | 5/482 |

FOREIGN PATENT DOCUMENTS

| | | | |
|---|---|---|---|
| 1185153 | 3/1970 | United Kingdom | 297/465 |

*Primary Examiner*—Peter M. Cuomo
*Assistant Examiner*—Rodney B. White

[57] ABSTRACT

A protective cover for an infant or child in a baby swing or infant carrier device such as a baby car seat, bicycle seat, or stroller. The cover has a top sheet and a bottom sheet formed by folding a single continuous sheet. The top and bottom sheet are removably connected by snaps or a zipper. The snaps are aligned and spaced an equal distance apart along the outer edges of the sheets, so the size of the enclosure can be adjusted by fastening the relevant snaps. The top sheet has an adjustable flap defining an opening for the baby's head.

11 Claims, 2 Drawing Sheets

PROTECTIVE COVER FOR AN INFANT IN A BABY SWING OR CARRIER

This application claims the benefit of U.S. Provisional Application No. 60/043,680, filed Apr. 14, 1997. This application is filed by the same inventor Thomas M. Stevens as said provisional application, and is filed within 12 months of and is copending with said provisional application. The subject matter claimed in this application was disclosed in said provisional application in compliance with the requirements of 35 U.S.C. 112, first paragraph.

FIELD OF THE INVENTION

The present invention relates to protective covers such as garments and blankets for infants and small children, and more particularly, to an improved protective cover for use with an infant in a baby swing or infant carrier device such as a baby car seat, bicycle seat, or stroller.

BRIEF DESCRIPTION OF THE PRIOR ART

Parents of infants and small children are familiar with a device often referred to as a baby swing, generally the motorized or wind-up type having a swingable seat part suspended from fixed supports. A baby is placed in the swing for a nap or simply for the baby's amusement, and often the baby is left in the baby swing for more than a very short period of time. Baby swings are used indoors and outdoors, and sometimes a baby in a baby swing gets cold and/or uncomfortable. When used outdoors, the baby may be exposed to inclement weather and/or insects. Even when used indoors, the baby and swing may be in a drafty place in order for the parents to keep an eye on the baby, or the baby may get cold simply because babies are smaller than adults and retain less heat.

Parents currently have few solutions to this problem. They can put a blanket over the baby, but this is often not effective because the swinging motion of the baby swing can cause the blanket to fall off the baby. A second option is to dress the baby with heavier clothes. This is often not a good solution, for example, where the baby is already napping or where the child will not comfortably fit into the baby swing with additional layers of clothing. Children tend to cool off when they sleep because their bodies are not generating heat from activity, but attempting to put more clothing on a sleeping child will usually waken the child.

Several infant protective covers are available, such as U.S. Pat. Nos. 4,946,221 and 5,437,061, all of which have shortcomings and none of which address the problems of maintaining the infant's warmth and comfort. U.S. Pat. No. 4,946,221 provides an infant seat cover, but is not adaptable for use with a baby swing, is not adjustable in size for a growing baby, does not have an adjustable opening for the baby's head, and is not suited for lying flat for use as a blanket. U.S. Pat. No. 5,437,061 provides a protective garment-type cover for use with child users and carriages therefor, but is not adaptable for use with a baby swing and is not suited for lying flat for use as a blanket.

SUMMARY OF THE INVENTION

In accordance with the present invention, there is provided a protective cover providing parents with a simple and practical way to keep their baby warm and/or protected from moisture, insects and inclement weather while the baby is in a baby swing. The cover is used with a baby swing, but can also be used with infant carrier devices, such as a baby car seat, bicycle seat, or stroller.

The present invention has a top and bottom sheet formed by folding a single sheet. The sheets are removably connected by a zipper along a substantial portion of the edges of the sheets. The cover is designed to fit over a baby in a baby swing, substantially covering both the baby and the seat part of the swing. The cover is sized to fit over the baby and the seat part, large enough for freedom of movement by the baby but not so large that the swinging seat part catches on the fixed supports. The cover keeps the baby warm and/or protected from the elements, so bulky, uncomfortable and constricting clothing are not needed. The cover can be easily installed or removed from a sleeping baby without waking the baby.

The top sheet has an adjustable flap which defines an opening for the baby's head. The flap has snaps or VELCRO fasteners, for securing the flap in place and permitting quick and easy opening and closing of the flap. The flap is adjustable, so that the size of the opening can be increased or decreased.

An alternate embodiment of the present invention provides the fold at the end of the sheets opposite the flap. In this embodiment, the top and bottom sheets are connected by snaps aligned and spaced an equal distance apart along the outer edges of the sheets, so the size of the enclosure can be adjusted by mating different snaps together. This embodiment is particularly well suited to use with infant carriers such as car seats because of the adjustability of the enclosure size. Because of the adjustable size of the enclosure provided, this embodiment also allows for use of the cover with an infant as it grows larger.

These and other features of the present invention are discussed or apparent in the following detailed description.

BRIEF DESCRIPTION OF THE DRAWINGS

The various features and advantages of the invention will be apparent from the attached drawings, in which.

DETAILED DESCRIPTION OF THE PREFERRED EMBODIMENT

Figure 1:
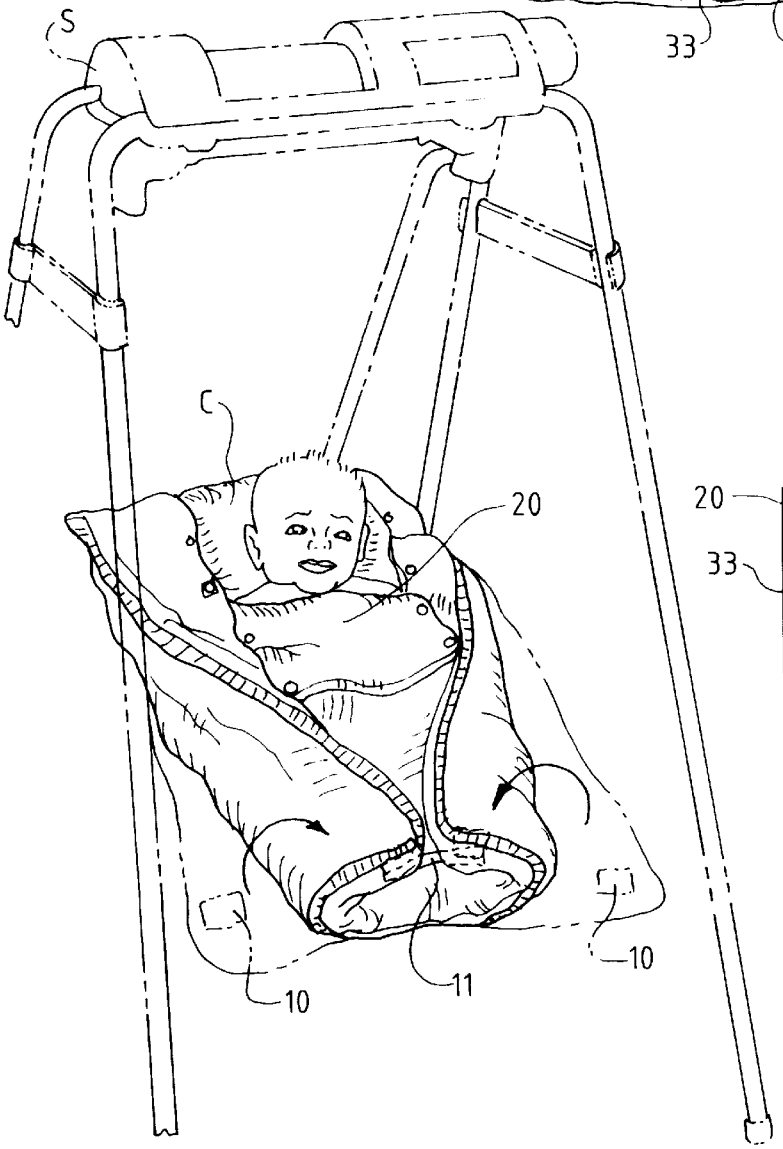
FIG. 1 is a perspective view showing the protective cover in use with an infant in a baby swing.
Figure 3:
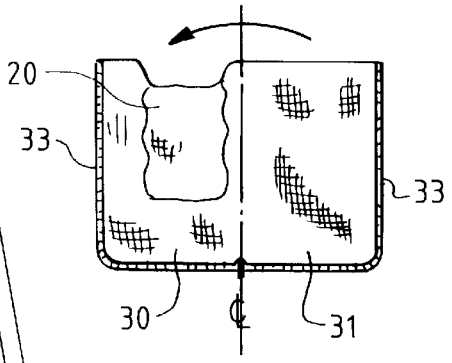
FIG. 3 is a top plan view showing the protective cover in the "opened" position.

Referring now to FIG. 1, there is illustrated a preferred embodiment of the present invention, showing the cover used with a baby in a baby swing. As shown in FIG. 3, the cover has a top sheet (30) and a bottom sheet (31). The top and bottom sheets are formed by a continuous wall having a fold (40). The top and bottom sheets are connected by removable fasteners (33), such as a zipper or snaps, along a substantial portion of the outer edges (32) of the sheets. The cover can be "opened" by unzipping the zipper, allowing installation over the seat and the baby. The cover can be used as a double-layered blanket when zipped close, or as a larger single layer blanket when unzipped and opened. The cover can also be used as a conventional sleeping bag for a small child.

Figure 4:
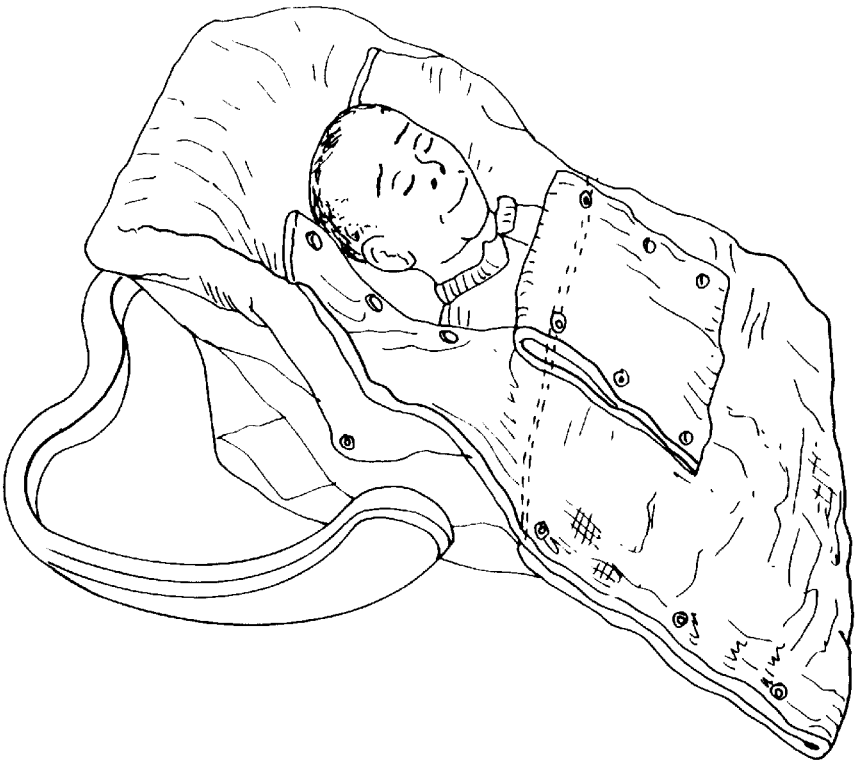
FIG. 4 is a perspective view of an alternate embodiment showing the protective cover in use with an infant in a car seat.
Figure 5:
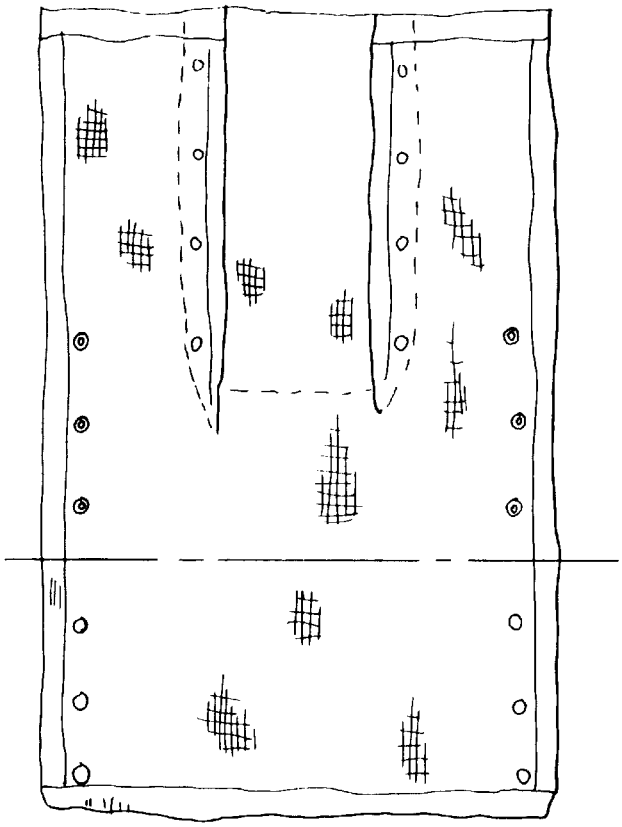
FIG. 5 is a bottom plan view of an alternate embodiment in the "opened" position showing the protective cover with an adjustable bottom sheet.

Referring now to FIG. 4, there is illustrated an alternate embodiment of the present invention, showing the cover used with a baby in a car seat. As shown in FIG. 5, this embodiment provides the fold (40) at the end of the sheets opposite the flap (20). In this embodiment, the top and bottom sheets are connected by removable fasteners (34) such as snaps or VELCRO fasteners. The fasteners (34) are aligned and spaced an equal distance apart along the outer edges of the sheets, so the size of the enclosure can be adjusted by mating different snaps together. This embodiment is particularly well suited to use with infant carriers such as car seats because of the adjustability of the enclosure size. Because of the adjustable size of the enclosure provided, this embodiment also allows for use of the cover with an infant as it grows larger.

Figure 2:
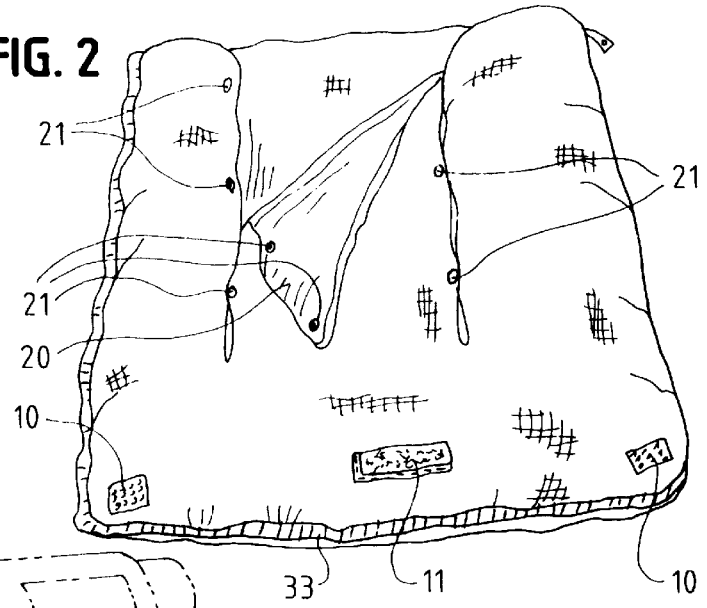
FIG. 2 is a perspective view showing the protective cover with the flap defining the opening for the baby's head.

Referring now to FIG. 2, the cover has a flap (20) in the top sheet (30) defining an opening for the baby's head. The flap (20) has removable fasteners (21), such as snaps or VELCRO fasteners, for securing the flap in place and permitting quick and easy opening and closing of the flap. The flap is adjustable, so that the size of the opening can be increased or decreased. The flap can be adjusted to provide an opening size large enough to fit a baby through when putting the baby in the seat part. The flap can be adjusted to provide an opening size so that only the baby's head is exposed, or to provide intermediate opening sizes exposing some of the baby's torso and/or hands and arms. Each side of the flap can be adjusted independently of the other side. Adjusting the opening size also adjusts the warmth and/or protection provided, so that comfort is maintained.

The cover has removable fasteners (10), such as snaps or VELCRO fasteners, on the top sheet (30) for keeping the corners securely tucked in so they do not catch on the fixed swing supports while the seat part is in motion. The cover can be made with illustrations of cartoon characters, animals, or other pictorial works. The cover can be made with arm holes for exposing the baby's hands and/or arms. The cover can be made with rattles and/or other baby toys attached to the inside or outside of the flap. The cover can be made with a built-in pillow for the baby's head. The cover can be made with pockets or pouches for holding pacifiers, bottles, toys, or other baby accessories.

The cover can be made of an insulating material such as cotton, wool, synthetic fibers, or a combination of these to keep the infant warm. The cover can also be made of a rubberized, polymer or other synthetic material, or have a rubberized, polymer or other synthetic material outer layer, to provide protection from moisture and inclement weather. The cover can include an inner layer of cotton or other soft material that is gentle on the baby's skin.

It will be appreciated that this application covers all such embodiments and modifications that fall within the true scope and spirit of the claims provided hereinafter.

What is claimed is:

1. A protective cover for an infant in the seat of a baby swing or carrier comprising a unitary insulated sheet folded to form top and bottom cover portions defining cooperating edge portions, cooperating fastening means provided on said cooperating edge portions for retaining the top and bottom portions together to form a closed bottom portion and an open end portion to define an enclosed space into which an infant can be placed to keep the infant warm when disposed therebetween, a centrally disposed wide flap defined by the top portion and extending downwardly from the upper end portion, cooperating fastening means formed on the flap and top portion whereby the flap can be disengaged from the top portion to form whatever opening desired for an infant's head whereby the edge connected portions of said sheet define an enclosure for substantially enclosing the infant and the seat.

2. A protective cover as set forth in claim 1 in which the sheet is folded transversely in half to form top and bottom portions and the flap portion is located in the half that forms the top portion whereby when the infant is located between the top and bottom portions and the flap is opened his head will rest on the bottom portion.

3. A protective cover as set forth in claim 2 in which the closed bottom portion defines fastening means so the bottom portion can be wrapped about the infant's feet.

4. A protective cover as set forth in claim 2 whereby the outer edges of the top and bottom portions can be provided with cooperating fastener means that when fastened will add a further layer of protection for the infant.

5. A protective cover as set forth in claim 4 in which the fastener means comprises a plurality of snap sets.

6. A protective cover as set forth in claim 4 in which the fastener means comprises a zipper means.

7. A protective cover as set forth in claim 1 in which the sheet is folded from the bottom up and thus it is adjustable to accommodate infants of different sizes.

8. A protective cover in accordance with claim 1 including a soft inner liner that is gentle on an infant's skin.

9. A protective cover in accordance with claim 1 including storage pockets on the top cover.

10. A protective cover in accordance with claim 1 including arm holes in the top cover for extending the infant's arms therethrough.

11. A protective cover in accordance with claim 1 including a layer of material attached to the bottom sheet opposite the flap means in the top cover and defining an opening for housing a pillow.

* * * * *